US008323001B2

(12) United States Patent
Kinjo et al.

(10) Patent No.: US 8,323,001 B2
(45) Date of Patent: Dec. 4, 2012

(54) HERMETIC COMPRESSOR

(75) Inventors: Kenji Kinjo, Shiga (JP); Ko Inagaki, Shinga (JP)

(73) Assignee: Panasonic Corporation, Osaka (JP)

( * ) Notice: Subject to any disclaimer, the term of this patent is extended or adjusted under 35 U.S.C. 154(b) by 153 days.

(21) Appl. No.: 12/751,354

(22) Filed: Mar. 31, 2010

(65) Prior Publication Data

US 2010/0260621 A1 Oct. 14, 2010

(30) Foreign Application Priority Data

Apr. 10, 2009 (JP) ..... 2009-095845

(51) Int. Cl.
*F04B 39/00* (2006.01)
*F04B 53/00* (2006.01)

(52) U.S. Cl. ..... 417/312; 181/232; 181/263; 181/403

(58) Field of Classification Search ..... 417/312; 181/229, 403, 232, 236
See application file for complete search history.

(56) References Cited

U.S. PATENT DOCUMENTS

| | | | | |
|---|---|---|---|---|
| 3,864,064 | A * | 2/1975 | Gannaway | 417/312 |
| 5,207,564 | A * | 5/1993 | Fritchman | 417/312 |
| 5,224,840 | A * | 7/1993 | Dreiman et al. | 417/312 |
| 5,304,044 | A * | 4/1994 | Wada et al. | 417/312 |
| 5,577,898 | A * | 11/1996 | Lee | 417/312 |
| 5,722,818 | A * | 3/1998 | Ohta et al. | 417/312 |
| 6,280,153 | B1 * | 8/2001 | Iversen et al. | 417/312 |
| 6,402,484 | B1 * | 6/2002 | Svendsen et al. | 417/312 |
| 6,572,345 | B2 * | 6/2003 | Seo | 417/312 |
| 7,083,400 | B2 * | 8/2006 | Possamai et al. | 417/559 |
| 2002/0017425 | A1 * | 2/2002 | Yoon et al. | 181/292 |
| 2010/0260621 | A1 * | 10/2010 | Kinjo et al. | 417/312 |

FOREIGN PATENT DOCUMENTS

| | | |
|---|---|---|
| WO | 98/07987 | 2/1998 |
| WO | 98/22712 | 5/1998 |
| WO | 03/038280 | 5/2003 |
| WO | 2005/019645 | 3/2005 |

OTHER PUBLICATIONS

King, R. P. "Chapter 2 Flow of Fluids in Piping Systems." Introduction to Practical Fluid Flow. Oxford: Butterworth-Heinemann, 2002. Print.*

* cited by examiner

*Primary Examiner* — Devon Kramer
*Assistant Examiner* — Joseph Herrmann
(74) *Attorney, Agent, or Firm* — Hamre, Schumann, Mueller & Larson, P.C.

(57) ABSTRACT

A compression element is provided with a block, a piston, a valve plate arranged in an opening end of a compression chamber and forming a suction hole, a suction valve, a suction muffler forming a sound absorbing space and provided with a communication pipe, and a cylinder head, the communication pipe has a suction muffler outlet portion communicated with the suction hole, is arranged in such a manner as to extend in a vertical direction with respect to a center line passing through the suction hole, and is arranged in such a manner that a part of the suction muffler outlet portion covers a part of the suction hole in the suction muffler outlet portion positioned in a downstream side of refrigerant gas flowing through the communication pipe, in the case of projection the suction muffler outlet portion in a direction of a center line.

9 Claims, 7 Drawing Sheets

HERMETIC COMPRESSOR

BACKGROUND OF THE INVENTION

1. Field of the Invention

The present invention relates to a suction muffler of a hermetic compressor used for a domestic electric refrigerator freezer, a display case and the like.

2. Description of the Related Art

In recent years, there has been an increasingly strong request for global environment protection, and in a refrigerator and other refrigerating cycle apparatuses, there has been a strong demand particularly for high efficiency. Conventionally, this kind of hermetic compressor is structured such that a suction muffler is directly attached to a suction hole, as shown in Japanese Translation of PCT Publication No. 2001-503833.

A description will be given below of the conventional hermetic compressor mentioned above with reference to the drawings.

FIG. 5 is a vertical cross sectional view of a conventional hermetic compressor described in Japanese Translation of PCT Publication No. 2001-503833, FIG. 6 is a cross sectional view of a substantial part of a refrigerant suction path of the hermetic compressor, and FIG. 7 is a flow rate vector diagram showing refrigerant gas behavior in the refrigerant suction path of the hermetic compressor.

In FIGS. 5 and 6, compressor main body 3 is elastically supported in hermetic vessel 1 by suspension spring 5. Further, refrigerant gas 7 is filled in hermetic vessel 1.

Compressor main body 3 is provided with electromotive element 9 and compression element 11 arranged above electromotive element 9, and electromotive element 9 has stator 13 and rotor 15.

Compression element 11 is provided with crank shaft 21, cylinder block 25, piston 27, suction valve 33, and connecting means 35. In this case, crank shaft 21 is provided with eccentric shaft 17 and main shaft 19. Cylinder block 25 forms compression chamber 23. Suction valve 33 opens and closes suction hole 31. Suction hole 31 is provided in valve plate 29 sealing an opening end of compression chamber 23. Connecting means 35 couples eccentric shaft 17 and piston 27.

Main shaft 19 is rotatably supported to bearing portion 37 of cylinder block 25. Further, rotor 15 is fixed to main shaft 19.

Further, suction muffler 41 is pinched and fixed by valve plate 29 and cylinder head 39. In this case, cylinder head 39 lids valve plate 29.

Suction muffler 41 is molded from a resin such as polybutylene terephthalate (PBT). Suction muffler 41 is provided with muffler main body 45, inlet pipe 47, and communication pipe 51. In this case, muffler main body 45 forms sound absorbing space 43. Inlet pipe 47 communicates sound absorbing space 43 and a space inside hermetic vessel 1. Communication pipe 51 has suction muffler outlet portion 49, and suction muffler outlet portion 49 directly communicates sound absorbing space 43 and suction hole 31.

Further, bent portion 53 is provided between suction muffler outlet portion 49 and communication pipe 51. Communication pipe 51 is arranged in such a manner as to extend in a vertical direction with respect to a center line passing through suction hole 31, and is fixed in such a manner that the entire region of suction hole 31 is communicated with suction muffler outlet portion 49.

FIG. 7 shows flow rate vectors 55 showing behavior of refrigerant gas 7 sucked into compression chamber 23 via communication pipe 51 obtained by a computer simulation. A length of each of the flow rate vectors 55 indicates a magnitude of the flow rate, and a direction of flow rate vectors 55 indicates a flowing direction of refrigerant gas 7. Note that, in order to easily understand the flow of refrigerant gas 7, suction valve 33 is shown by a broken line.

A description will be given below of a motion of the conventional hermetic compressor constructed as mentioned above.

First, the hermetic compressor passes a current through stator 13 to generate a magnetic field, thereby rotating rotor 15 fixed to main shaft 19. This rotates crank shaft 21 to reciprocate piston 27 in compression chamber 23 through connecting means 35 rotatably attached to eccentric shaft 17.

With the reciprocating motion of piston 27, refrigerant gas 7 is suctioned into compression chamber 23, compressed, and then discharged to a refrigerating cycle (not shown) in repeating fashion.

Refrigerant gas 7 returned from the refrigerating cycle in a suction stroke is introduced into compression chamber 23 via suction hole 31 communicating with compression chamber 23 according to the opening and closing of suction valve 33, through suction muffler 41.

In this case, suction muffler 41 reduces a noise generated by an intermittent suction of refrigerant gas 7. Further, since suction muffler 41 is formed by a resin having a low thermal conductivity, it prevents refrigerant gas 7 passing through the inside of suction muffler 41 from being heated.

Further, suction muffler outlet portion 49 is communicated directly with suction hole 31, thereby preventing the noise from leaking. Further, suction muffler outlet portion 49 is communicated directly with suction hole 31, thereby preventing refrigerant gas 7 having a high temperature and heated by electromotive element 9 or the like from being sucked in hermetic vessel 1.

However, in the conventional structure mentioned above, since communication pipe 51 and suction muffler outlet portion 49 have bent portion 53 which is vertically bent, dead water region (area) 57 having no flow of refrigerant gas 7 is generated in an inner peripheral side of bent portion 53, as shown in FIG. 7. Since dead water region 57 is formed, a flow path area of refrigerant gas 7 becomes small. Accordingly, in suction muffler outlet portion 49, a density (a flow rate) of refrigerant gas 7 flowing through communication pipe 51 becomes more in an outer side of bent portion 53 than that in dead water region 57 side, refrigerant gas 7 is concentrated on a downstream side, and more refrigerant gas 7 flows while increasing a flow rate. Therefore, dead water region 59 having no flow of refrigerant gas 7 is generated in suction hole 31, an effective area coming to the refrigerant gas passage of suction hole 31 becomes small, and there is a problem of deteriorating volumetric efficiency.

SUMMARY OF THE INVENTION

A hermetic compressor in accordance with the present invention is provided with a block accommodating a compression element driven by a electromotive element within a hermetic vessel, the compression element forming a compression chamber, a piston reciprocating in the compression chamber, a valve plate arranged in an opening end of the compression chamber and forming a suction hole, a suction valve opening and closing the suction hole, a suction muffler forming a sound absorbing space and provided with a communication pipe, and a cylinder head pressing and fixing the valve plate to the block from an opposite side to the compression chamber, wherein the communication pipe has a suction muffler outlet portion communicating with the suction hole, is arranged in such a manner as to extend in a vertical direction to a center line passing through the suction hole, and is arranged in such a manner that a part of the suction muffler outlet portion positioned in a downstream side of the refrigerant gas flowing through the communication pipe covers a part of the suction hole in a state in which the suction muffler outlet portion is projected in a center line direction.

The hermetic compressor mentioned above is structured such that in the suction muffler outlet portion, a side in which the refrigerant gas flows more comes close to the center of the suction hole, whereby the refrigerant gas discharged from the suction muffler outlet portion flows into the vicinity of the center of the suction hole. Accordingly, it is possible to increase an effective area of the suction hole, and it is possible to improve volumetric efficiency.

DETAILED DESCRIPTION OF THE PREFERRED EMBODIMENT

A description will be given below of an embodiment in accordance with the present invention with reference to the accompanying drawings. It should be noted that this invention is not limited by this embodiment.

Embodiment

Figure 1:
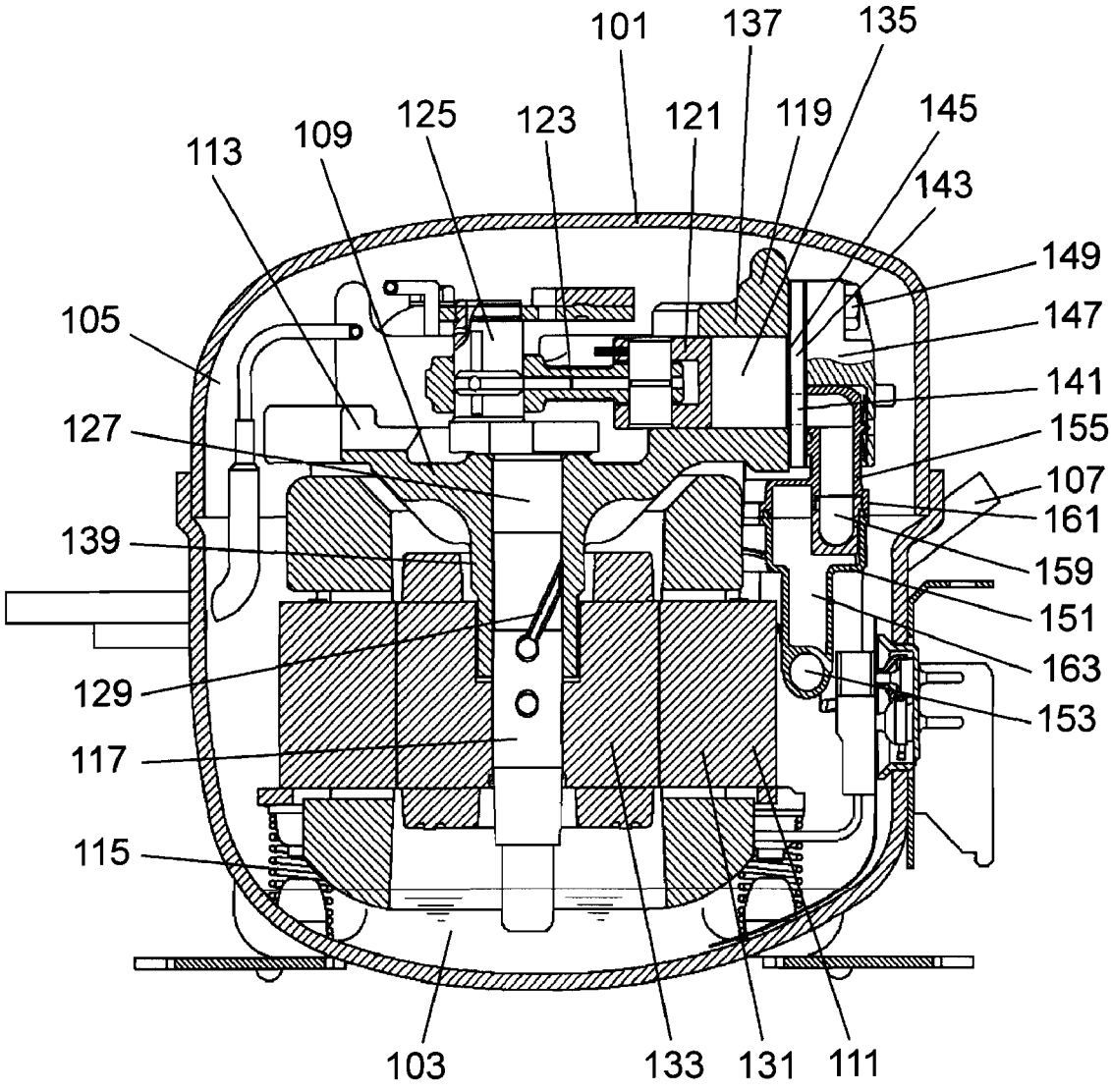
FIG. 1 shows a vertical cross sectional view of a hermetic compressor in accordance with an embodiment of the present invention.
Figure 2:
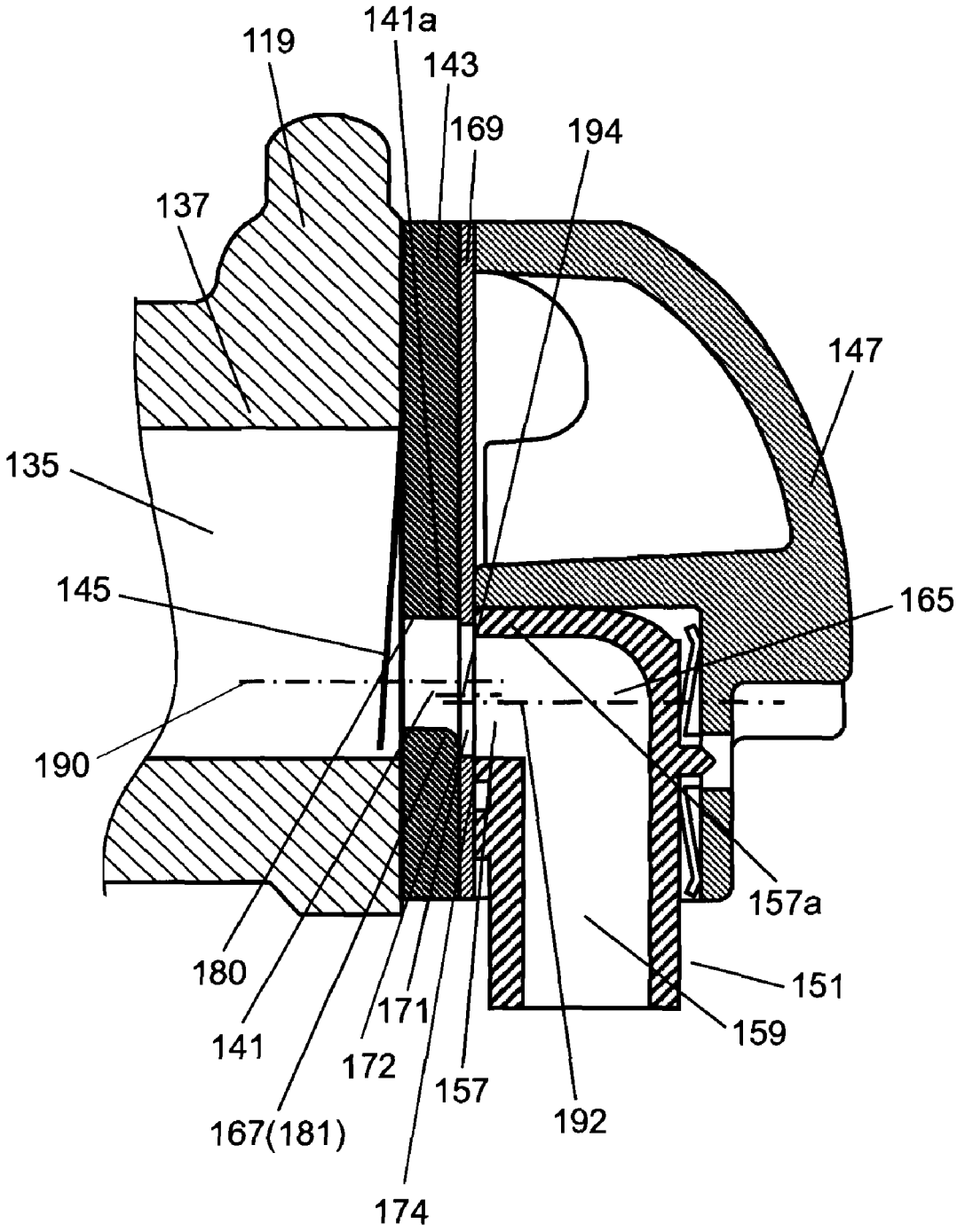
FIG. 2 shows a cross sectional view of a substantial part of a refrigerant suction path of the hermetic compressor in accordance with the embodiment.
Figure 3:
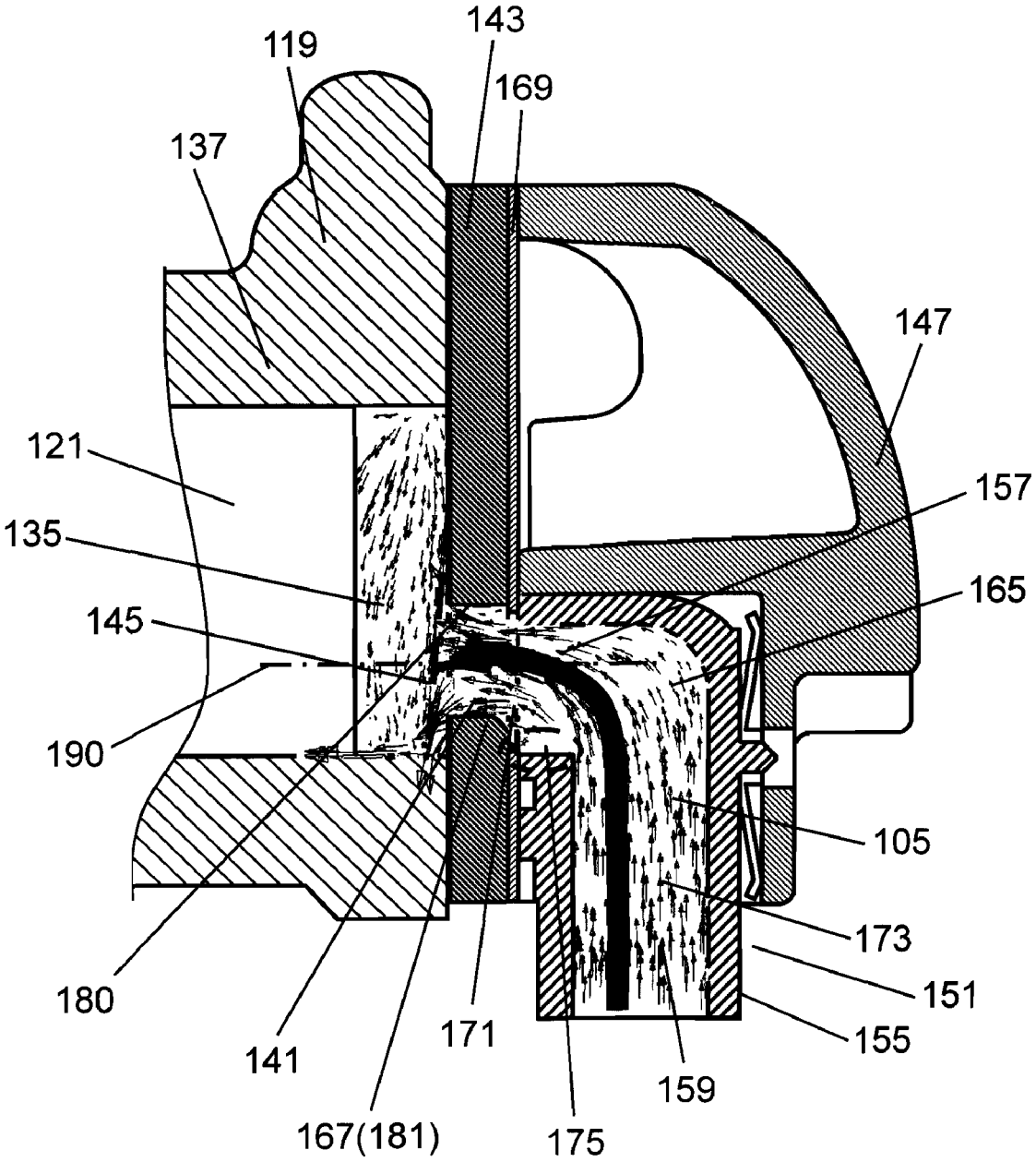
FIG. 3 shows a flow rate vector diagram showing refrigerant gas behavior in the refrigerant suction path in accordance with the embodiment.
Figure 4:
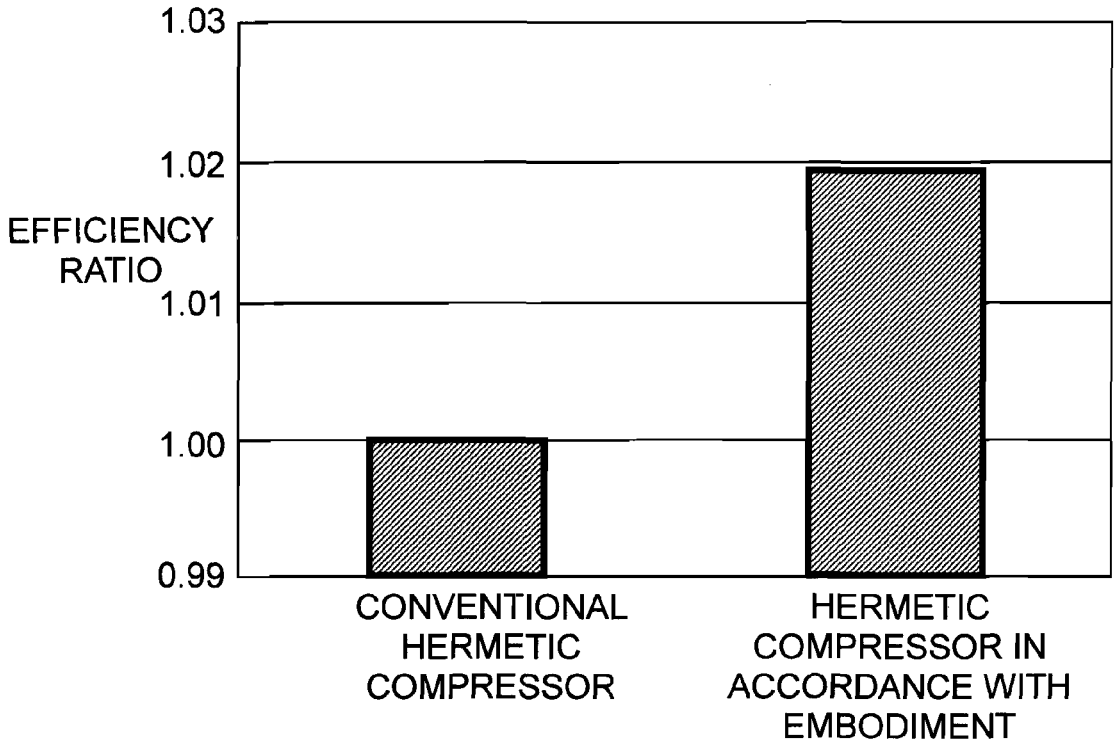
FIG. 4 shows a characteristic comparative diagram showing a result of measurement of volumetric efficiency of the hermetic compressor in accordance with the embodiment.
Figure 5:
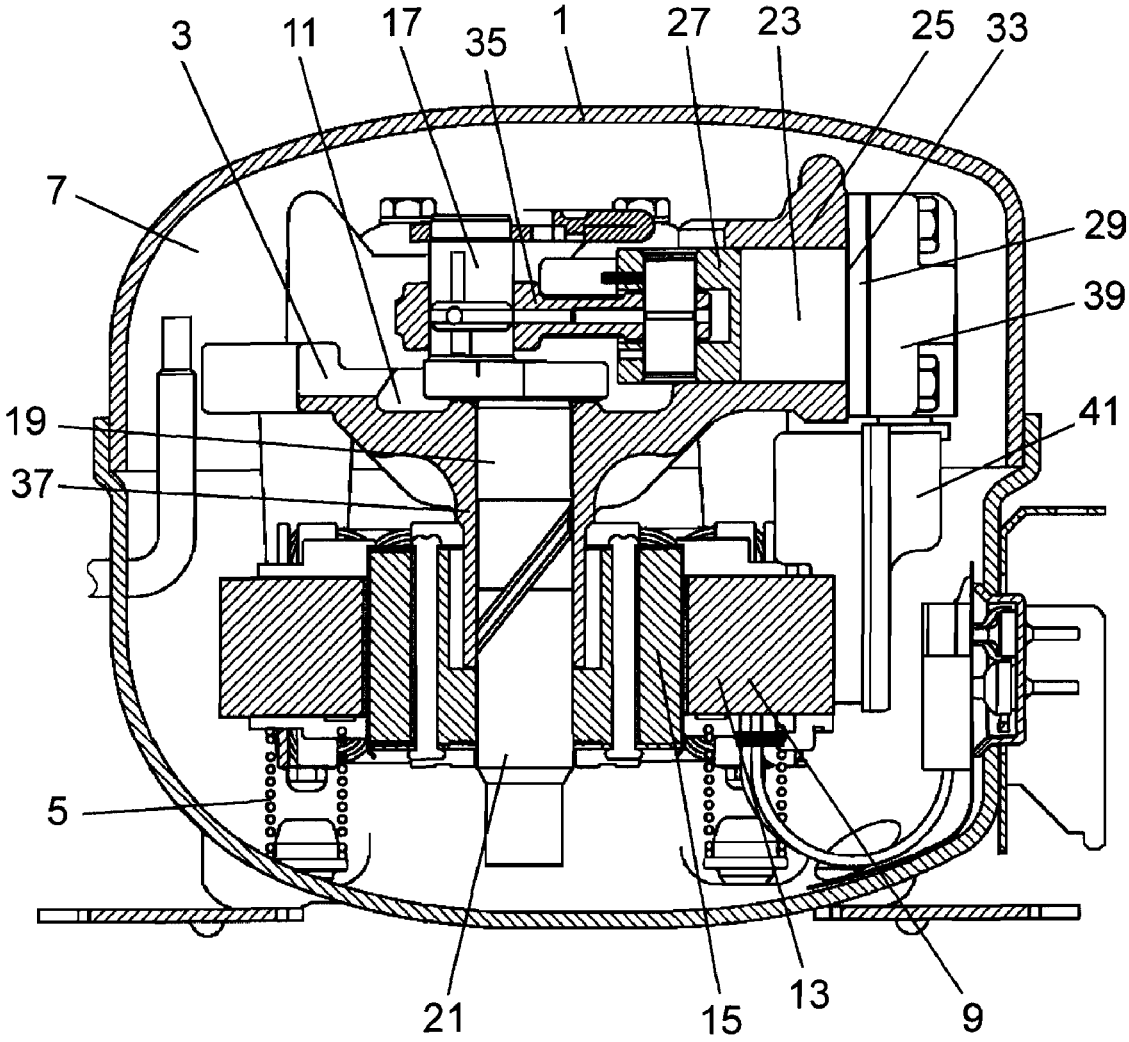
FIG. 5 PRIOR ART
FIG. 5 shows a vertical cross sectional view of a conventional hermetic compressor.
Figure 6:
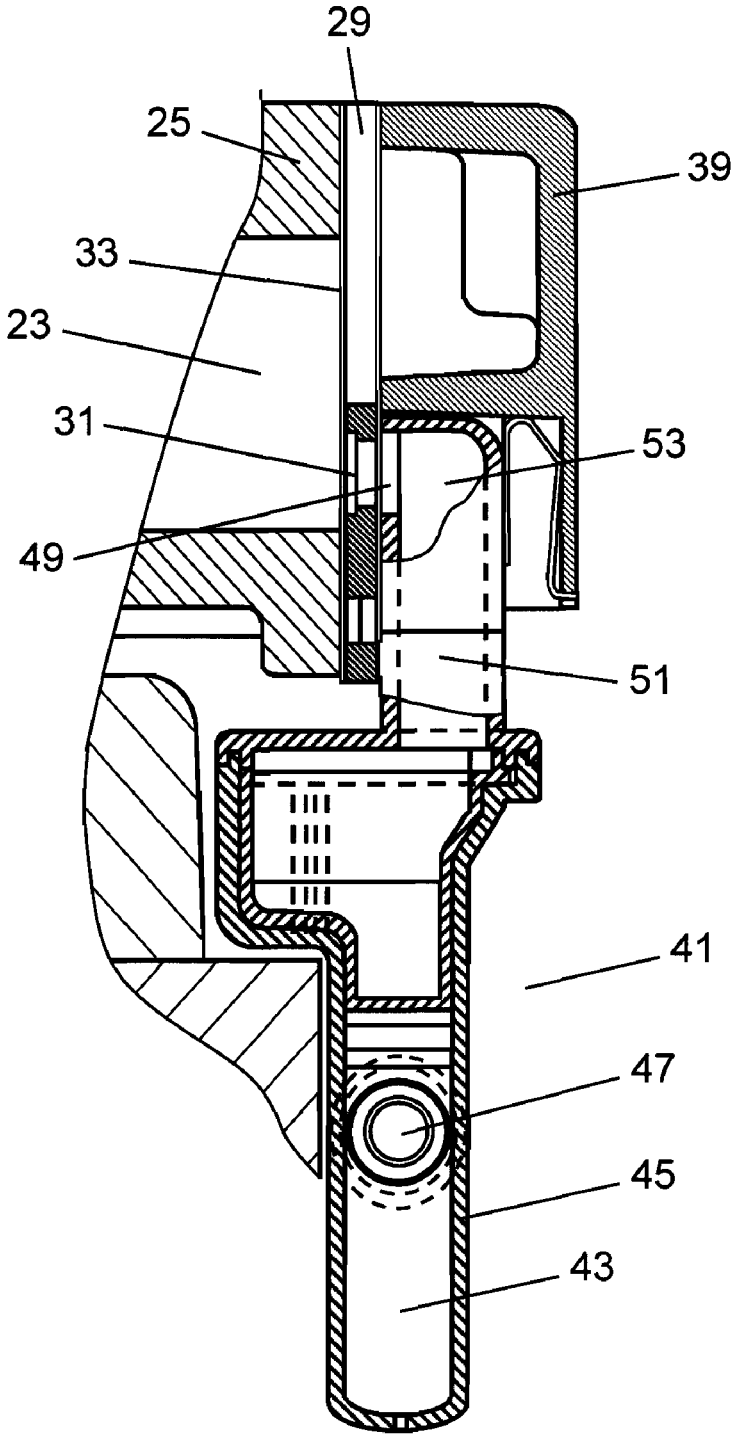
FIG. 6 PRIOR ART
FIG. 6 shows a cross sectional view of a substantial part of a refrigerant suction path of the conventional hermetic compressor.
Figure 7:
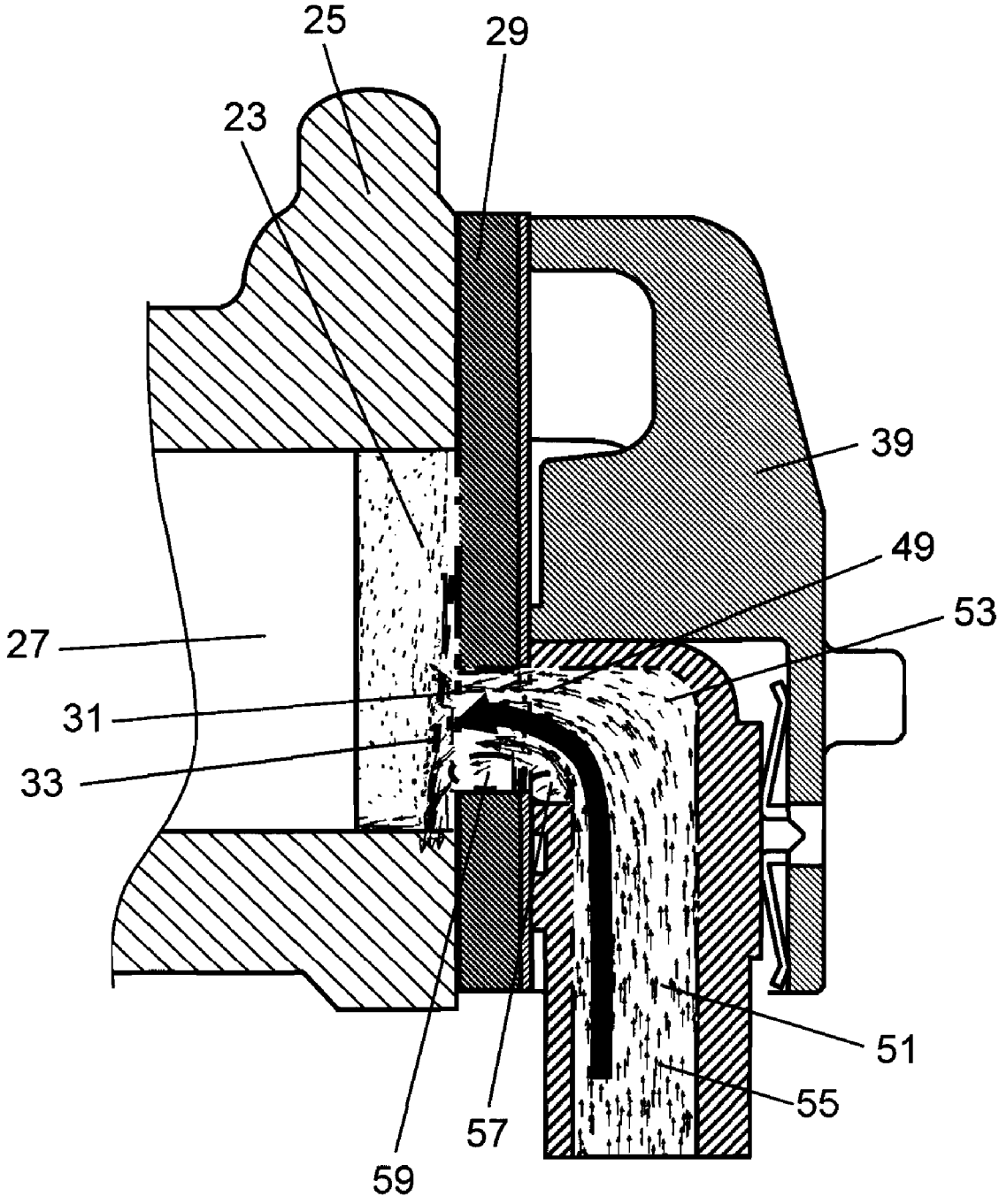
FIG. 7 PRIOR ART
FIG. 7 shows a flow rate vector diagram showing refrigerant gas behavior in the refrigerant suction path of the conventional hermetic compressor.

FIG. 1 is a vertical cross sectional view of a hermetic compressor in accordance with an embodiment of the present invention, FIG. 2 is a cross sectional view of a substantial part of a refrigerant suction path of the hermetic compressor, FIG. 3 is a flow rate vector diagram showing refrigerant gas behavior in the refrigerant suction path of the hermetic compressor, FIG. 4 is a characteristic comparative diagram showing a result of measurement of volumetric efficiency of the hermetic compressor. FIG. 4 is the characteristic comparative diagram showing the volumetric efficiency of the hermetic compressor in accordance with the present embodiment, at a time of setting volumetric efficiency of a conventional hermetic compressor to 1.

In FIGS. 1 and 2, the hermetic compressor in accordance with the embodiment of the present invention is structured such that oil 103 is reserved in an inner bottom portion of hermetic vessel 101, and seals refrigerant gas 105, for example, hydro carbon refrigerant R600a having a low global warming potential or the like, therein.

Further, hermetic vessel 101 is provided with suction pipe 107 formed by drawing an iron plate. Suction pipe 107 is communicated with an inner side of hermetic vessel 101 at its one end, and is connected to a low pressure side (not shown) of a refrigerating cycle at its other end.

Further, compressor main body 113 is elastically supported to hermetic vessel 101 by suspension spring 115, and is stored in hermetic vessel 101. In this case, compressor main body 113 is provided with compression element 109 and electromotive element 111. Further, compression element 109 is driven by electromotive element 111.

Compression element 109 is constructed by crank shaft 117, block 119, piston 121, valve plate 143, suction valve 145, suction muffler 151, cylinder head 147, connecting means 123 and the like. Crank shaft 117 is provided with eccentric shaft 125 and main shaft 127, and is provided with oiling mechanism 129 constructed by a spiral groove, for example, provided in a surface of main shaft 127.

Electromotive element 111 is constructed by stator 131 fixed to a lower side of block 119 by a bolt (not shown), and rotor 133 coaxially arranged inside stator 131 and fixed to main shaft 127 by shrink-fitting.

Cylinder 137 forming compression chamber 135 is integrally formed in block 119, and block 119 is provided with bearing portion 139 rotatably supporting main shaft 127.

Further, valve plate 143, suction valve 145, and cylinder head 147 are pressed and fixed to an opening end of cylinder 137 in such a manner as to seal the opening end of cylinder 137 by head bolt 149. Further, suction muffler 151 is gripped and fixed to the opening end of cylinder 137 by valve plate 143 and cylinder head 147. In this case, valve plate 143 is provided with suction hole 141 and a discharge hole (not shown). In other words, valve plate 143 is arranged in an opening end of the compression chamber, and forms suction hole 141. Suction valve 145 opens and closes suction hole 141. Cylinder head 147 presses and fixes valve plate 143 to block 119 from an opposite side to the compression chamber. Accordingly, valve plate 143 is pinched and fixed by cylinder 137 and cylinder head 147.

Suction muffler 151 is molded from a synthetic resin such as a polybutylene terephthalate (PBT) with mainly glass fiber added thereto. Further, suction muffler 151 is integrated by combining muffler main body 155 and cover 161, and forms sound absorbing space 163. In this case, muffler main body 155 is molded integrally with inlet pipe 153. Cover 161 is provided with communication pipe 159, and communication pipe 159 has cylindrical suction muffler outlet portion 157 communicating with suction hole 141.

Further, bent portion 165 is arranged between suction muffler outlet portion 157 and communication pipe 159. Communication pipe 159 is arranged in such a manner as to extend in a vertical direction with respect to center line 190 vertically passing through suction hole 141 with respect to its opening surface.

Further, suction muffler outlet portion 157 is arranged at such a position that center line 192 vertically passing through with respect to an opening end surface is somewhat shifted below in the drawing with respect to center line 190 passing through suction hole 141.

In other words, with reference to FIG. 2, suction muffler 151 is arranged in such a manner that upward wall portion 157*a* of suction muffler outlet portion 157 positioned in a downstream side of refrigerant gas 105 flowing through communication pipe 159 laps over inner peripheral upper edge portion 141*a* of suction hole 141, in a state (as seen from a right side in FIG. 2) in which suction hole 141 is projected in a direction in which center line 190 vertically passing through with respect to the opening surface of the suction hole extends, and an inlet lower portion peripheral edge of suction hole 141 is protruded in such a manner as to obstruct an inner peripheral lower edge 174 of suction muffler outlet portion 157.

In other words, respective shapes and dimensions of suction hole 141 and suction muffler outlet portion 157 are set such that upper wall portion 157*a* of suction muffler outlet portion 157 laps over inner peripheral upper edge portion 141*a* of suction hole 141 so as to cover a part of suction hole 141, in the projection state mentioned above, and the inlet lower portion peripheral edge of suction hole 141 protrudes with respect to the inner peripheral lower edge of suction muffle outlet portion 157, at a time when center lines 190 and 192 respectively passing through vertically suction hole 141 and suction muffler outlet portion 157 are in the somewhat shifted positional relationship as mentioned above.

In this case, in the embodiment in accordance with the present invention, an area of suction hole 141 covered by the overlapping of wall portion 157*a* of suction muffler outlet portion 157 is set to about 17% of a cross sectional area of cylindrical portion 180 mainly constructing suction hole 141. As a result, a maximum dimension (distance) in a radial direction of suction hole 141 covered by wall portion 157*a* of suction muffler outlet portion 157 is set to about 17% of an inner diameter of cylindrical portion 180 mainly constructing suction hole 141.

Valve plate 143 is formed of a sintered metal, and has suction flow path 167 conducting refrigerant gas 105 toward suction hole 141 in a peripheral edge of an inlet lower portion of suction hole 141 protruding with respect to an inner peripheral lower edge of suction muffler outlet portion 157, as mentioned above.

Suction flow path 167 is communicated with suction muffler outlet portion 157. Further, suction flow path 167 is provided with guide portion 181 positioned in an upstream side of refrigerant gas 105 flowing through communication pipe 159. In other words, suction flow path 167 is a guide portion smoothening the flow of refrigerant gas 105 heading for suction hole 141 from an end surface 172 close to suction muffler outlet portion 157.

Specifically, guide portion 181 is formed in such a shape that a cross section is curved like a round shape.

Further, gasket 169 is arranged between valve plate 143 and suction muffler 151. Gasket 169 is opposed to both suction hole 141 of valve plate 143 and suction muffler outlet portion 157. Further, gasket 169 is provided with communication hole 171.

Further, communication hole 171 is formed with an opening area which is larger than an opening area of suction hole 141, and does not obstruct an opening area of suction muffler outlet portion 157, and is communicated with approximately all the opening area of suction muffler outlet portion 157. Further, communication hole 171 is structured such that center line 194 vertically passing through communication hole 171 with respect to an opening surface of the communication hole 171 is shifted slightly downward in FIG. 2 with respect to center line 190 passing through suction hole 141.

FIG. 3 shows flow rate vectors 173 indicating behavior of refrigerant gas 105 sucked into compression chamber 135 via communication pipe 159 obtained by a computer simulation. A length of each of the flow rate vectors 173 indicates a magnitude of the flow rate, and a direction of flow rate vectors 173 indicates a flowing direction of refrigerant gas 105. In this case, in order to easily understand the flow of refrigerant gas 105, suction valve 145 is shown by a broken line.

A description will be given below of a motion and an operation of the hermetic compressor constructed as mentioned above.

The hermetic compressor passes a current through stator 131 to generate a magnetic field, thereby rotating rotor 133 fixed to main shaft 127 to rotate crank shaft 117. As a result, piston 121 reciprocates in cylinder 137 via connecting means 123 rotatably attached to eccentric shaft 125. Further, refrigerant gas 105 is sucked into compression chamber 135 via suction muffler 151 in accordance with a reciprocating motion of piston 121, and is discharged to the refrigerating cycle (not shown) after being compressed.

Next, a description will be given of a suction stroke of the hermetic compressor.

If piston 121 is actuated in a direction of increasing a volumetric capacity in compression chamber 135 from a top dead center, refrigerant gas 105 in compression chamber 135 is inflated. As a result, the pressure in compression chamber 135 is lowered, and suction valve 145 starts opening depending on a difference between the pressure in compression chamber 135 and the pressure in suction muffler 151.

Further, refrigerant gas 105 returning from the refrigerating cycle and having a low temperature is once released into hermetic vessel 101 from suction pipe 107, and is thereafter released to sound absorbing space 163 via inlet pipe 153 of suction muffler 151. Further, released refrigerant gas 105 flows into compression chamber 135 via communication pipe 159.

Thereafter, if the motion of piston 121 is turned to a direction of reducing the volumetric capacity in compression chamber 135 from a bottom dead center, the pressure in compression chamber 135 rises. Further, suction valve 145 is closed depending on a difference between the pressure in compression chamber 135 and the pressure in suction muffler 151.

In this case, suction muffler 151 constructs an expansion type muffler together with inlet pipe 153, communication pipe 159, and sound absorbing space 163. Further, since suction muffler 151 seals suction muffler outlet portion 157 and suction hole 141 so as to directly communicate, by arranging gasket 169 between suction muffler outlet portion 157 and valve plate 143, it reduces a noise generated by an intermittent suction of refrigerant gas 105. Further, it is possible to prevent the suction of refrigerant gas 105 heated by electromotive element 111 or the like in hermetic vessel 101.

Further, suction muffler 151 is formed by a resin having a low thermal conductivity. Accordingly, it is possible to prevent overheating of refrigerant gas 105 passing through the inside of suction muffler 151 by being affected by a heat generation of electromotive element 111. As a result, since it is possible to suck refrigerant gas 105 having a large density into compression chamber 135, a mass flow rate of refrigerant gas 105 is increased, and it is possible to improve volumetric efficiency.

In this case, suction muffler 151 has the bent portion which is bent at a right angle between suction muffler outlet portion 157 and communication pipe 159. Accordingly, as shown in FIG. 3, dead water region (area) 175 having no flow of refrigerant gas 105 is generated in an inner peripheral side of bent portion 165. As a result, in suction muffler outlet portion 157, a density (a flow rate) of refrigerant gas 105 flowing through communication pipe 159 becomes higher in an outer side of bent portion 165 than in dead water region 175 side, refrigerant gas 105 is concentrated on the downstream side, and more refrigerant gas 105 flows while increasing a flow rate.

However, in suction muffler 151 of the hermetic compressor in accordance with the present embodiment, suction muffler outlet portion 157 is arranged in such a manner that wall portion 157*a* corresponding to a part of suction muffler outlet portion 157 laps over the upper portion of suction hole 141 so as to cover suction hole 141, as seen in FIG. 2. As a result, as shown in FIG. 3, a side opposite the dead water region 175 in which refrigerant gas 105 of suction muffler outlet portion 157 flows more is closer to center line 190 passing through suction hole 141.

Accordingly, refrigerant gas 105 discharged from suction muffler outlet portion 157 tends to be conducted to suction hole 141 in the more flowing side. As a result, it is believed that the opening area of suction hole 141 effectively serves as a passage of refrigerant gas 105, and refrigerant gas 105 is flowed into compression chamber 135.

Further, in a state in which suction muffler outlet portion 157 is projected in the direction of center line 190 passing through suction hole 141, an area at which suction hole 141 is covered by wall portion 157*a* corresponding to a part of suction muffler outlet portion 157 is set to about 17% of the opening area of cylindrical portion 180 mainly constructing suction hole 141. Further, a maximum dimension (distance) in a radial direction of suction hole 141 covered by a part of suction muffler outlet portion 157 is set to about 17% with respect to an inner diameter of cylindrical portion 180 of suction hole 141.

As a result, it is possible to increase an effective area of suction hole 141 without increasing a flow path resistance in the portion in which suction muffler outlet portion 157 and suction hole 141 are coupled, and it is possible to improve volumetric efficiency.

In this case, in the embodiment in accordance with the present invention, the area of suction hole 141 covered by a part of suction muffler outlet portion 157 is set to about 17%. However, it is confirmed that the same effect can be obtained as long as the area is in a range of being equal to or more than about 10% and equal to or less than about 20% of the opening area of cylindrical portion 180 mainly constructing suction hole 141. In other words, in the range in which the area is equal to or more than about 10% and equal to or less than about 20%, it is possible to increase the effective area of suction hole 141 while making the flow path resistance approximately uniform, and it is possible to improve the volumetric efficiency.

The above results are obtained by setting the area of suction hole 141 covered by wall portion 157*a* corresponding to a part of suction muffler outlet portion 157 to a proper range. If the area is set to be too small with respect to the opening area of cylindrical portion 180, the effect of reducing the flow path resistance by making the main flow of refrigerant gas 105 of suction muffler outlet portion 157 close to center line 190 passing through suction hole 141 becomes small, and it is impossible to achieve an improvement of the volumetric efficiency.

On the contrary, if the opening area of suction hole 141 covered by a part of suction muffler outlet portion 157 is set to be too large with respect to the opening area of cylindrical portion 180, a substantial flow path area of cylindrical portion 180 becomes small. Accordingly, it is believed that the effect of reducing the flow path resistance is reduced.

Further, it is confirmed that the same effect can be obtained by setting the maximum dimension (distance) in the radial direction of suction hole 141 covered by a part of suction muffler outlet portion 157 to a range of being equal to or more than about 5% and equal to or less than about 20% with respect to an inner diameter of cylindrical portion 180 mainly constructing suction hole 141, in a state of projecting suction muffler outlet portion 157 in the direction of center line 190 passing through suction hole 141.

In accordance with the result mentioned above, in the same manner, it is believed that if the maximum dimension (distance) in the radial direction of suction hole 141 covered by a part of suction muffler outlet portion 157 is set to be too small with respect to the inner diameter of cylindrical portion 180 mainly constructing suction hole 141, the effect of reducing the flow path resistance by making the main flow of refrigerant gas 105 of suction muffler outlet portion 157 close to center line 190 passing through suction hole 141 becomes small.

On the contrary, if the maximum dimension (distance) in the radial direction of suction hole 141 covered by a part of suction muffler outlet portion 157 is set to be too large with respect to the inner diameter of cylindrical portion 180 mainly constructing suction hole 141, the substantial flow path cross sectional area of cylindrical portion 180 becomes small. Accordingly, it is believed that the effect of reducing the flow path resistance is reduced.

As mentioned above, it is possible to achieve a reduction of the flow path resistance, by paying attention to a ratio of the area of suction hole 141 covered by a part of suction muffler outlet portion 157 with respect to an opening area of cylindrical portion 180, and a ratio of a maximum dimension (distance) in a radial direction of suction hole 141 covered by a part of suction muffler outlet portion 157 with respect to an inner diameter of cylindrical portion 180.

Next, a description will be given of a relation among suction hole 141 of valve plate 143, communication hole 171 of gasket 169 and suction muffler outlet portion 157.

Conventionally, suction hole 141 of valve plate 143, and communication hole 171 of gasket 169 are formed by a concentric circle having approximately the same diameter, however, there is a case that a step is generated between suction hole 141 and communication hole 171 due to a working tolerance. A micro vortex is generated in the flow of refrigerant gas 105 discharged from suction muffler outlet portion 157, due to this step. As a result, a resistance is generated in the flow of refrigerant gas 105, and there is a possibility of lowering the volumetric efficiency.

Accordingly, communication hole 171 is communicated with suction muffler outlet portion 157 in approximately all of the region, and communication hole 171 is formed in such a manner that the opening area of the communication hole 171 is larger than suction hole 141, and the opening area of the communication hole 171 communicating with suction muffler outlet portion 157 is maximized.

Further, center line 194 passing through communication hole 171 is slightly deflected to an upstream side of refrigerant gas 105 flowing through communication pipe 159, from center line 190 passing through suction hole 141. Accordingly, since an end surface of communication hole 171 is arranged so as to face a region coming to dead water region 175 of suction muffler outlet portion 157, and can prevent the micro vortex from being generated, it is possible to reduce the flow resistance of refrigerant gas 105, and it is possible to improve efficiency.

Further, valve plate 143 has suction flow path 167 conducting the refrigerant gas toward suction hole 141 and having the curved cross section, and suction flow path 167 comes to a guide portion of refrigerant gas 105 heading for suction hole 141 from the end surface close to suction muffler outlet portion 157. In other words, since the flow of refrigerant gas 105 passing through suction flow path 167 becomes smooth by the curved surface of suction flow path 167, it is possible to prevent separation of the flow, and it is possible to conduct refrigerant gas 105 to suction hole 141 in a state in which a turbulence is small.

Further, it is possible to prevent the separation of the flow of refrigerant gas 105, to reduce the flow resistance of refrigerant gas 105 flowing into suction hole 141 from suction muffler outlet portion 157, and to further improve the volumetric efficiency, by forming suction flow path 167.

In this case, in the embodiment in accordance with the present invention, suction flow path 167 is formed by guide portion 181 having the curved shape. However, guide portion 181 may be formed in such a manner that the cross section of the guide portion 181 is of a shape forming an inclined surface having a slope about 45 degrees with respect to the center line passing through suction hole 141. In the shape of the inclined surface mentioned above, the flow path resistance is increased more than the curved shape, however, it is possible to prevent the separation of the flow of refrigerant gas 105 in comparison with the conventional structure.

As a result of the above, it is possible to increase refrigerant gas 105 flowing in suction hole 141, and an improvement of the volumetric efficiency by about 2% in comparison with the conventional structure is confirmed by the experiment as shown in FIG. 4.

What is claimed is:

1. A hermetic compressor comprising:

a block accommodating a compression element driven by a electromotive element within a hermetic vessel, the compression element forming a compression chamber;

a piston reciprocating in the compression chamber;

a valve plate arranged at an open end of the compression chamber, the valve plate including a suction hole formed therein;

a suction valve opening and closing the suction hole;

a suction muffler forming a sound absorbing space and provided with a communication pipe;

a cylinder head pressing and fixing the valve plate to the block from an opposite side to the compression chamber;

the communication pipe has a suction muffler outlet portion communicating with the suction hole, the suction muffler outlet portion is arranged to extend in a vertical direction to a center line passing through the suction hole, the suction muffler outlet portion including an edge that defines an outlet and that faces the compression chamber, and a part of the edge of the suction muffler outlet portion positioned at a downstream side of refrigerant gas that is flowing through the communication pipe overlaps a part of the suction hole in a state in which the suction muffler outlet portion is projected in a direction of the center line passing through the suction hole;

a gasket is sandwiched between the valve plate and the suction muffler with the edge of the suction muffler portion abutting against the gasket, the gasket is provided with a communication hole which is opposed to both of the suction hole and the outlet of the suction muffler outlet portion and communicates with the suction hole and the suction muffler outlet portion, a center of the communication hole is located at an upstream side of the refrigerant gas flow path, a cross sectional area of the communication hole is larger than a cross sectional area of the suction hole, and an entire region of the communication hole is communicated with the suction muffler outlet portion; and wherein a maximum dimension in a radial direction of the suction hole overlapped by the part of the edge of the suction muffler outlet portion is in a range of being equal to or more than 5% and equal to or less than 20% of an inner diameter of the cylindrical portion of the suction hole, in a projection in the direction of the center line passing through the suction hole.

2. The hermetic compressor according to claim 1, wherein the refrigerant gas flow path through the valve plate comprises a suction flow path guiding the refrigerant gas toward the suction hole, and the suction flow path includes a guide portion that guides flow into the suction hole at an end of the valve plate that faces the suction muffler outlet portion.

3. The hermetic compressor according to claim 2, wherein the guide portion is communicated with the suction muffler outlet portion, and the guide portion is provided in the suction hole at the upstream side of the refrigerant gas flow path, in a projection in the direction of the center line passing through the suction hole.

4. A hermetic compressor comprising:

a block accommodating a compression element driven by a electromotive element within a hermetic vessel, the compression element forming a compression chamber;

a piston reciprocating in the compression chamber;

a valve plate arranged at an open end of the compression chamber, the valve plate including a suction hole formed therein;

a suction valve opening and closing the suction hole;

a suction muffler forming a sound absorbing space and provided with a communication pipe;

a cylinder head pressing and fixing the valve plate to the block from an opposite side to the compression chamber;

the communication pipe has a suction muffler outlet portion communicating with the suction hole, the suction muffler outlet portion is arranged to extend in a vertical direction to a center line passing through the suction hole, the suction muffler outlet portion including an edge that defines an outlet and that faces the compression chamber, and a part of the edge of the suction muffler outlet portion positioned at a downstream side of refrigerant gas that is flowing through the communication pipe overlaps a part of the suction hole in a state in which the suction muffler outlet portion is projected in a direction of the center line passing through the suction hole;

a gasket is sandwiched between the valve plate and the suction muffler with the edge of the suction muffler portion abutting against the gasket, the gasket is provided with a communication hole which is opposed to both of the suction hole and the outlet of the suction muffler outlet portion and communicates with the suction hole and the suction muffler outlet portion, a center of the communication hole is located at an upstream side of the refrigerant gas flow path, a cross sectional area of the communication hole is larger than a cross sectional area of the suction hole, and an entire region of the communication hole is communicated with the suction muffler outlet portion; and a cross sectional area of the suction hole overlapped by the part of the edge of the suction muffler outlet portion is in a range of being equal to or more than 10% and equal to or less than 20% of a cross sectional area of a cylindrical portion of the suction hole, in a projection in the direction of the center line passing through the suction hole.

5. A hermetic compressor comprising:

a block accommodating a compression element driven by a electromotive element within a hermetic vessel, the compression element forming a compression chamber;

a piston reciprocating in the compression chamber;

a valve plate arranged in an opening end of the compression chamber, the valve plate including a suction hole formed therein;

a suction valve opening and closing the suction hole;

a suction muffler forming a sound absorbing space and provided with a communication pipe; and a cylinder head pressing and fixing the valve plate to the block from an opposite side to the compression chamber, wherein the communication pipe has a suction muffler outlet portion communicating with the suction hole, and is arranged to extend in a vertical direction to a center line passing through the suction hole, and a part of the suction muffler outlet portion positioned in a downstream side of refrigerant gas that is flowing through the communication pipe covers a part of the suction hole in a state in which the suction muffler outlet portion is projected in a direction of the center line passing through the suction hole, wherein a gasket is arranged between the valve plate and the suction muffler, the gasket is provided with a communication hole which is opposed to both of the suction hole and the suction muffler outlet portion and communicates with the suction hole and the suction muffler outlet portion, a center of the communication hole is located at an upstream side of the refrigerant gas flow path, a cross sectional area of the communication hole is larger than a cross sectional area of the suction hole, and an entire region of the communication hole is communicated with the suction muffler outlet portion; and a maximum dimension in a radial direction of the suction hole covered by the part of the suction muffler outlet portion is in a range of being equal to or more than 5% and equal to or less than 20% of an inner diameter of the cylindrical portion of the suction hole, in a projection in the direction of the center line.

6. A hermetic compressor comprising:

a block accommodating a compression element driven by a electromotive element within a hermetic vessel, the compression element forming a compression chamber;

a piston reciprocating in the compression chamber;

a valve plate arranged in an opening end of the compression chamber, the valve plate including a suction hole formed therein;

a suction valve opening and closing the suction hole;

a suction muffler forming a sound absorbing space and provided with a communication pipe; and a cylinder head pressing and fixing the valve plate to the block from an opposite side to the compression chamber, wherein the communication pipe has a suction muffler outlet portion communicating with the suction hole, and is arranged to extend in a vertical direction to a center line passing through the suction hole, and a part of the suction muffler outlet portion positioned in a downstream side of refrigerant gas that is flowing through the communication pipe covers a part of the suction hole in a state in which the suction muffler outlet portion is projected in a direction of the center line passing through the suction hole, wherein a gasket is arranged between the valve plate and the suction muffler, the gasket is provided with a communication hole which is opposed to both of the suction hole and the suction muffler outlet portion and communicates with the suction hole and the suction muffler outlet portion, a center of the communication hole is located at an upstream side of the refrigerant gas flow path, a cross sectional area of the communication hole is larger than a cross sectional area of the suction hole, and an entire region of the communication hole is communicated with the suction muffler outlet portion; and a cross sectional area of the suction hole covered by the part of the suction muffler outlet portion is in a range of being equal to or more than 10% and equal to or less than 20% of a cross sectional area of a cylindrical portion of the suction hole, in a projection in the direction of the center line passing through the suction hole.

7. The hermetic compressor according to claim 1, wherein the communication hole is formed so that the cross sectional area communicating with the suction muffler outlet portion is maximized.

8. The hermetic compressor according to claim 1, wherein the refrigerant gas flow path through the valve plate comprises a suction flow path guiding the refrigerant gas toward the suction hole, and the suction flow path includes a guide portion heading for the suction hole from an end surface close to the suction muffler outlet portion.

9. The hermetic compressor according to claim 8, wherein the guide portion is communicated with the suction muffler outlet portion, and is provided in the suction hole at the upstream side of the refrigerant gas flow path, in a projection in the direction of the center line passing through the suction hole.

* * * * *